US009508540B2

(12) United States Patent
Barnes et al.

(10) Patent No.: US 9,508,540 B2
(45) Date of Patent: Nov. 29, 2016

(54) METHOD AND APPARATUS USEFUL FOR IMAGING

(75) Inventors: Alan Barnes, Derbyshire (GB); Rod Fry, Greater Manchester (GB)

(73) Assignee: KRATOS ANALYTICAL LIMITED, Manchester (GB)

( * ) Notice: Subject to any disclaimer, the term of this patent is extended or adjusted under 35 U.S.C. 154(b) by 287 days.

(21) Appl. No.: 12/602,541

(22) PCT Filed: Jun. 2, 2008

(86) PCT No.: PCT/GB2008/001876

§ 371 (c)(1),
(2), (4) Date: Dec. 1, 2009

(87) PCT Pub. No.: WO2008/146026

PCT Pub. Date: Dec. 4, 2008

(65) Prior Publication Data

US 2010/0176288 A1 Jul. 15, 2010

(30) Foreign Application Priority Data

Jun. 1, 2007 (GB) ..... 0710555.4

(51) Int. Cl.
*H01J 49/00* (2006.01)
*H01J 49/16* (2006.01)

(52) U.S. Cl.
CPC ..... *H01J 49/164* (2013.01); *H01J 49/0004* (2013.01)

(58) Field of Classification Search
None
See application file for complete search history.

(56) References Cited

U.S. PATENT DOCUMENTS 5,808,300 A 9/1998 Caprioli
6,080,586 A * 6/2000 Baldeschwieler ..... B82Y 20/00 250/282

(Continued)

FOREIGN PATENT DOCUMENTS

GB 2376794 12/2002
WO 96/03768 2/1996

(Continued)

OTHER PUBLICATIONS

John C. Jurchen et al., MALDI-MS Imaging of Features Smaller than the Size of the Laser Beam, American Society for Mass Spectrometry, 2005, No. 16, pp. 1654-1659.

*Primary Examiner* — Andrew Smyth
(74) *Attorney, Agent, or Firm* — Sughrue Mion, PLLC

(57) ABSTRACT

The present invention provides a method of generating ions from a sample, the method comprising the steps of (1) designating a plurality of sample target sites, and (2) for each of said plurality of sample target sites, generating ions from a plurality of locations associated with the sample target site, wherein said plurality of locations are selected automatically with reference to the said sample target site. Each of the plurality of sample target sites is associated with a discrete sample region, wherein the sample is part of a MALDI ion source and the plurality of discrete sample regions comprise regions of matrix, suitably formed by chemical inkjet printing. The plurality of locations can be at least 5 and preferably at least 10 locations, each of which can be selected randomly or in accordance with a predetermined pattern. Ions generated from the plurality of locations associated with each of the sample target sites are assigned only a single set of sample position coordinates, which coordinates correspond to those of the sample target site. This averaging technique leads to improved data reliability.

26 Claims, 5 Drawing Sheets

(56) References Cited

U.S. PATENT DOCUMENTS 6,719,449 B1 * 4/2004 Laugharn, Jr. ..... B01F 11/02 366/127
7,166,202 B2 * 1/2007 Bukshpan ..... G01N 27/44795 204/459
7,282,707 B1 * 10/2007 Zanon ..... H01J 49/0409 250/281
7,338,762 B2 * 3/2008 Gorenstein ..... C07H 21/00 435/4
7,522,282 B2 * 4/2009 Nolte ..... G01N 21/253 356/450
7,714,276 B2 * 5/2010 Pevsner ..... G01N 33/6851 250/282
7,914,656 B2 * 3/2011 Bukshpan ..... G01N 27/44795 204/548
2002/0041418 A1 4/2002 Fillion et al.
2002/0051738 A1 * 5/2002 Schurenberg ..... B01L 3/5085 422/400
2003/0102215 A1 * 6/2003 Bukshpan ..... G01N 27/44747 204/459
2004/0183006 A1 * 9/2004 Reilly ..... H01J 49/164 250/282
2004/0197921 A1 * 10/2004 Schurenberg ..... B01L 3/5085 436/43
2004/0217278 A1 * 11/2004 Overney ..... H01J 49/0418 250/288
2004/0219531 A1 * 11/2004 DiCesare ..... B01L 3/5085 435/6.13
2004/0236520 A1 * 11/2004 Williams ..... G01N 27/44717 702/22
2005/0123939 A1 * 6/2005 Gorenstein ..... G01N 33/6851 506/6
2005/0236564 A1 * 10/2005 Keller ..... H01J 49/0413 250/288
2006/0110833 A1 5/2006 Agnes et al.
2006/0138319 A1 6/2006 Barnes et al.
2006/0247863 A1 * 11/2006 Bui ..... G06T 7/0004 702/19
2006/0263259 A1 11/2006 Chernokalskaya et al.
2006/0275855 A1 * 12/2006 Blackburn ..... C12Q 1/00 435/15
2007/0114375 A1 * 5/2007 Pevsner ..... G01N 33/6851 250/282
2007/0114388 A1 * 5/2007 Ogawa ..... H01J 49/0004 250/288
2007/0138015 A1 * 6/2007 Bukshpan ..... G01N 27/44795 204/548
2007/0157325 A1 * 7/2007 Mojtahedian ..... A01K 67/0275 800/12
2007/0254295 A1 * 11/2007 Harvey ..... C12Q 1/6886 435/6.18
2009/0166529 A1 * 7/2009 Shinma ..... G01N 35/1002 250/282

FOREIGN PATENT DOCUMENTS

WO 96/33797 10/1996
WO 03/044825 5/2003
WO 03/087806 10/2003

* cited by examiner

METHOD AND APPARATUS USEFUL FOR IMAGING

The present invention is concerned with a method and apparatus useful for imaging, particularly imaging of tissue samples using MALDI mass spectrometry.

Matrix assisted laser desorption/ionisation (MALDI) is a soft ionisation technique and is used to generate ions for analysis by mass spectrometry. It is particularly suitable for analysis of large organic molecules, macromolecules and biomolecules such as peptides and proteins.

MALDI mass spectrometry (MALDI-MS) works by firing a laser beam at the sample to generate ions. In practice, a matrix is applied to the sample to protect the molecules and macromolecules from being destroyed by direct laser irradiation. The matrix also assists in vaporising the desorbed material and typically provides a source of protons to aid ionisation.

Suitable matrices are well known to those skilled in the art. Typically the matrix is a comparatively low molecular weight organic compound that readily absorbs light at the wavelength of the laser (typically UV) and crystallises when applied to a sample. Examples of suitable compounds are 3,5-dimethoxy-4-hydroxycinnamic acid (sinapinic acid), α-cyano-4-hydroxycinnamic acid (alpha-cyano or alpha-matrix) and 2,5-dihydroxybenzoic acid (DHB). Trifluoroacetic acid (TFA) may also be added.

The matrix can be mixed with a sample (e.g. a sample containing a protein of interest) and then deposited on a sample stage (such that the sample or analyte co-crystallise). Alternatively the sample is placed on a sample plate and the matrix is applied on top of the sample, such that the matrix material permeates into the sample and crystallises in-situ. Typically, a sample prepared in this way is about 2 to 3 mm in diameter. Ions can then be generated by firing a laser at the matrix-encased sample at a designated sample target site.

Multiple laser shots are normally required at the designated sample target site in order to remove the uppermost layer of matrix and expose the sample/analyte underneath (particularly in the case where the matrix material has been applied to the sample on the sample stage). Typically, a pulsed laser is used. A further series of laser shots at the same sample target site is then normally required in order to generate multiple sets of ions, each set being analysed by MS. The resultant mass spectra can then be combined or averaged to provide an improved signal-to-noise ratio.

It is also known to acquire mass data from a number of different sample target sites. This is normally achieved by designating an appropriate number of sample target sites and then repeating the laser firing procedure at each sample target site. Typically, movement between sample target sites is achieved by moving the sample stage. The mass data acquired from the second and subsequence sample target sites can then be combined (e.g. averaged) with the data from the first sample target site to further improve signal-to-noise.

More recently, MALDI-MS has been used to study the distribution of molecules and macromolecules in a tissue sample. In such methods, mass data is acquired from a plurality of sample target sites as discussed above, however, instead of combining the data from each of the sample target sites, the data from each site can be used to create a "map" or image of the tissue sample. In particular, this technique can be used to illustrate the distribution in the sample of a biomarker (e.g. protein) that may be indicative of a pathological condition. This is illustrated in FIG. 1. discussed below.

A further development of this mapping or imaging technique relates to the way in which matrix is deposited on the sample. In this connection, it is known that applying the matrix to the tissue sample, e.g. by spraying, can cause diffusion of molecules within the tissue sample prior to crystallisation. This can adversely affect the reliability of the map or image of the sample because the detected amounts of a given biomarker may not in fact be attributable to the sample target site at which they were detected.

Accordingly, the way in which the matrix material is delivered to the sample has been adapted so that, instead of spraying over the whole of the sample, the matrix is deposited as tiny droplets over the tissue sample to form discrete regions. The droplets typically have a volume in the range 100 pL to 2000 pL and produce a substantially circular spot or micro-dot having a diameter in the range 50 μm to 200 μm. The spots or micro-dots (these two terms are used interchangeably herein) are formed in an array so that regular rows/columns of spots are formed on the sample. Typically, a chemical inkjet printer (such as Shimadzu's CHIP 1000™) is used to produce the array of spots. This reduces the problem of diffusion.

In order to obtain a map or image, each of the spots is placed under the laser by appropriate movement of the sample stage, so that the centre of the laser beam is aligned with the centre of the spot. Multiple laser shots are used in the normal way to generate multiple sets of ions, the mass data for all such sets of ions being combined or averaged to produce mass data for a particular spot. The mass data for each of the spots in the array is then collated to produce a map or image of the tissue sample (e.g. to show the concentration of a biomarker as measured for each spot). This is illustrated in FIG. 2, discussed below.

Whilst the above technique addresses the problem of diffusion within the matrix prior to crystallisation, the present inventors have noted that further drawbacks exist with current methods of acquiring mass data from MALDI samples.

In particular, the present inventors have noted that the matrix, when crystallised, may contain defects and other aberrations apparently caused by non-uniform crystallisation. Furthermore, such defects are present even within the comparatively small volume of the spots produced by chemical inkjet printers.

The present inventors have found that when a laser beam is incident on such a defect, the mass data acquired from that spot is likely to be of poor quality and unreliable. This means that an image of the sample compiled from such data may also be inaccurate and therefore unreliable. It follows that in the case where the sample is a pathology sample and the mass data relates to a biomarker for a medical condition, the lack of reliability may in turn make it more difficult to provide a reliable diagnosis.

The present inventors have also noted that the problem of a defect that coincides with the coordinates at which a laser is fired (i.e. the centre of a spot) cannot be overcome simply by acquiring more data from those coordinates because repeated firing of the laser will, beyond a certain number of firings, cause depletion of the sample, leading to a further reduction in the reliability of an image produced from such data.

Furthermore, the present inventors have also noted that the deposition of matrix material using inkjet-type technology can be non-uniform such that the thickness of matrix deposited within a spot can vary. Indeed, in some cases, there may be areas within the spot where no matrix is present. Thus, the present inventors have found that there is a risk that when acquiring mass data for a given spot in the conventional way, the ions generated from the spot will not be representative of the sample within that spot. This can further reduce the reliability of an image created from such data, with undesirable consequences if the image is to assist in the determination of a medical condition.

At its most general, the present invention proposes that the drawbacks discussed above can be addressed by generating ions from a plurality of locations associated with a single set of sample target coordinates (i.e. a designated sample target site). In particular, it is proposed that within a given target region, typically as defined by a spot of matrix, ions can be generated from a plurality of locations so that the mass data obtained from each of the locations can be processed to provide a single set of mass data for the target region (e.g. spot). In this way, the present invention addresses the drawbacks associated with imaging a sample by generating ions from a 2-D array of sample locations.

Thus, the present invention proposes that rather than generating ions from a single location associated with a designated sample target site (i.e. generating ions from the centre of each spot only), ions should be generated from a plurality of locations associated with the sample target site. The mass data from each of the plurality of locations can then be averaged and applied to the sample target site. Thus, in practice, when a sample target site (e.g. centre of a spot) is designated, the laser may "roam" around the designated sample target site. Indeed, the laser impact sites on the sample corresponding to the plurality of locations can be thought of as a "dithered" pattern on the sample.

In this way, the adverse effects on mass data associated with defects, including variation in the thickness of matrix, in the sample at a particular sample target site can be reduced or eliminated.

In a first aspect, the present invention provides a method of generating ions from a sample, the method comprising the steps of (1) designating a plurality of sample target sites, and
(2) for each of said plurality of sample target sites, generating ions from a plurality of locations associated with the sample target site.

Suitably, the said plurality of locations are selected automatically with reference to the said sample target site.

Preferably, the method includes the step of generating

Thus, in preferred embodiments, the plurality of sample target sites is designated, for example by indicating the location of said sample target sites on an optical image of the sample or, more usually, by importing coordinate data from a printer that has produced an array of spots on the sample. In practice, this may be achieved using software known to those skilled in the art.

Having designated the plurality of sample target sites (e.g. by importing coordinate data corresponding to an array of spots), the method of the present invention then generates ions from a plurality of locations associated with each of the designated sample target sites.

Suitably, there is no need for the user to input further coordinates and/or make further selections as to where the laser should be fired. Thus, the method of the present invention preferably automatically selects the said plurality of locations with reference to each of the designated sample target sites.

Typically, the plurality of locations are selected using an algorithm. Preferably the algorithm includes as one of its parameters the sample target site (suitably, the coordinates of the sample target site) with which the plurality of locations are associated. In this way, suitably the selection of the plurality of locations is based on the designated sample target site.

Thus, the present invention preferably provides a method wherein a first set of sample coordinates (the designated plurality of sample target sites) is used to generate a second set of sample coordinates (the plurality of locations associated with the sample target sites).

The method can be used in any method of generating ions from a sample. For example, it could be used in a method of rastering a sample wherein a laser moves over a sample to generate ions from a plurality of sample target sites, which sites are arranged consecutively along the sample (e.g. as rows, in a conventional "raster" pattern). The method of the present invention would then provide a "dithered" pattern overlaid on the raster. The dithering (or "roaming") corresponds to the plurality of locations associated with each point along the raster. The mass data obtained from the dithering (plurality of locations associated with each designated sample target site) can then be combined (e.g. averaged) and assigned to the designated sample target site. Preferably this leads to improved data reliability.

Alternatively, the method can be applied to samples comprising spots or arrays of discrete sample regions of the sort discussed above.

Thus, suitably each of the said plurality of sample target sites is associated with a discrete sample region (e.g. spot).

Preferably, the sample is part of a MALDI ion source and the plurality of discrete sample regions comprise regions (e.g. spots) of matrix.

As noted above, the matrix material can be selected from 3,5-dimethoxy-4-hydroxycinnamic acid (sinapinic acid), α-cyano-4-hydroxycinnamic acid (alpha-cyano or alpha-matrix) and 2,5-dihydroxybenzoic acid (DHB).

The present invention is particularly suited to discrete sample regions that have been formed by applying drops of matrix to the sample, such as those formed using a chemical ink jet printer. Preferably the method includes the step of applying an array of spots to the sample, suitably with a chemical inkjet printer. Suitably the coordinates of the spots (e.g. as recorded by the printer) correspond to the designated plurality of sample target sites.

Typically, the discrete sample regions are substantially circular and have a diameter of <500 μm, preferably <200 μm and more preferably <150 μm.

Suitably, the plurality of discrete sample regions comprise an array of spots. Thus, the present invention preferably provides a method of obtaining more reliable mass data for an array of spots of the sort well known in the art. Suitably, the plurality of locations are selected so as to be within the spot, i.e. the roaming or dithering occurs within the boundaries of the spot.

The method is particularly useful in the case where the array comprises at least 50 spots. Indeed, the advantages of the present invention (improved reliability, less "bad" data points, more accurate composition data) are increasingly useful as the array gets larger. Thus, preferably, the array comprises at least 10 columns and at least 10 rows, more preferably, at least 50 columns and at least 50 rows.

Suitably, the centre-to-centre separation of the sample target sites is no more than 500 μm, preferably no more than 300 μm.

The advantages of the method of the present invention are particularly valuable when the sample is a pathology sample, more preferably a tissue sample.

The dithering or roaming produces particularly good results if the said plurality of locations associated with each sample target site comprises at least five locations, more preferably at least 10 locations and most preferably at least 20 locations.

As noted above, the preferred automatic selection of the said plurality of locations can be based on a random or non-random selection.

A random selection may be advantageous if experiments are to be run more than once at the same sample target site (e.g. at the same spot). Random selection may reduce the likelihood of overlap of the respective plurality of locations (as between subsequent experiments), compared to repeated use of the same non-random pattern. Conversely, a non-random pattern (e.g. a predetermined pattern) can minimise the chance of overlap in a single experiment.

Suitably, the distance between each of the said plurality of locations and the sample target site with which they are associated is less than one half of the distance between adjacent sample target sites (e.g. the distance between centres of adjacent spots). In practice, in the case of an array of spots wherein the sports are nearly touching or touching, this means that the furthermost location from the centre of each spot at which ions are generated will be the edge of the spot.

More preferably, the said distance is less than one quarter of the distance between adjacent sample target sites.

Typically, the distance between each of the said plurality of locations is <100 μm, preferably <50 μm, more preferably <25 μm and most preferably <15 μm.

Suitably, the said plurality of sample target sites comprises at least 10 sample target sites, preferably at least 100 sample target sites. As noted above, preferably the sample target sites comprise an array of spots.

Preferably the step of generating ions from the said plurality of locations comprises firing a laser at the sample at each of the said plurality of locations.

Suitably the method comprises firing the laser at least twice at each of the said plurality of locations, preferably at least ten times.

Suitably, the method is a method of generating ions from an ion source in a mass spectrometer.

Preferably, the method comprises detecting at least some of the generated ions. Furthermore, the method includes the step of obtaining mass data about the ions generated at each of the said plurality of locations.

Suitably, the method includes the step of processing the said mass data to produce composition data relating to the composition of the sample at each of the plurality of sample target sites.

In preferred embodiments, the step of processing the said mass data comprises, for each of the plurality of sample target sites, averaging at least some of the mass data obtained from the said plurality of locations.

Preferably, the method comprises the further step of generating an image of the sample based on the processed mass data. The step of generating an image preferably comprises generating an image of the sample based on composition data for each of the plurality of sample target sites.

Preferably the method is a method of generating an image of a sample. Suitably the method includes acquiring ions from a plurality of sample target sites (preferably discrete sample regions), the sample target sites being arranged in a 2-D array.

In particularly preferred embodiments, the method includes detecting a mass associated with a biomarker, which biomarker is indicative of a pathological condition and generating an image of the sample based on the detected amounts of biomarker at each of the said plurality of sample target sites.

The present inventors have found that it is particularly advantageous if the coordinate data for each of the plurality of locations is not recorded and/or transmitted to the control and/or process means responsible for controlling the apparatus and/or processing the mass data. Indeed, they have found that significant savings in processing time and efficiency can be achieved by transmitting and/or recording only one set of coordinates for all of the plurality of locations.

Thus, preferably, the step of generating ions from a plurality of locations associated with one of the said plurality of sample target sites comprises communicating to a processing device only a single set of sample position coordinates for all of the said plurality of locations. Suitably the said single set of sample position coordinates corresponding to the coordinates of the sample target site with which the said plurality of locations is associated.

Suitably, the sample target site is associated with a discrete sample region and the said single set of sample position coordinates corresponds to the centre of the said discrete sample target region.

Preferably, for each of said plurality of sample target sites, the method includes processing mass data from all of the said plurality of locations with respect to the said single set of sample position coordinates.

As noted above, in preferred embodiments the sample is part of an ion source and in use a laser source provides a laser beam to generate ions from the sample. In such embodiments, preferably the step of generating ions from a plurality of locations associated with the sample target site includes moving the ion source with respect to the laser source.

Preferably moving the ion source with respect to the laser source comprises moving a sample stage to which the sample is attached.

Suitably the sample stage is moved by a stepper motor. Alternatively, the sample stage is moved by a linear motor.

The present inventors have found that the selection of the said plurality of locations can be achieved using the increments or step size of a stepper motor to generate an array of possible locations. Thus, preferably the said plurality of locations are selected based on the step size of the stepper motor. In this array, each of the plurality of locations can be spaced from the sample target site (typically the coordinates associated with the centre of a spot) by one or a multiple of stepper motor increments.

Typically the laser is a pulsed laser operated at a firing rate of at least 5 Hz, preferably at least 10 Hz.

The sample may be moved with respect to the laser in between firing of the laser, thereby reducing the time taken to generate the ions and obtain mass data. Alternatively, the sample may be moved with respect to the laser while simultaneously firing the laser.

In a second aspect, the present invention provides apparatus adapted to carry out the method of the first aspect.

Suitably, the apparatus is a mass spectrometer comprising an ion source, a laser and control means for controlling movement of the ion source with respect to the laser so that the laser can be fired at the said plurality of locations associated with the said sample target site. Suitably the apparatus is adapted to move the sample with respect to the laser such that ions from a 2-D array of sample target sites (suitably discrete sample regions) can be produced.

Preferably the control means comprises processing means for selecting automatically said plurality of locations with reference to the said sample target site.

Typically the processing means comprises software and/or firmware. Preferably, the processing means is configured (e.g. programmed) to select randomly the said plurality of locations.

Preferably the processing means configured to select the said plurality of locations in accordance with a predetermined pattern.

In a further aspect, the present invention provides software and/or firmware configured to carry out the method of the first aspect on an apparatus adapted to generate ions from a sample. Suitably, the software and/or firmware is for a mass spectrometer (preferably a MALDI mass spectrometer), such that the mass spectrometer can operate in accordance with the method of the first aspect.

Each of the aspects previously described may be combined with each other in any combination and features within each of the aspects may be combined with features from the other aspects.

The invention will now be described by way of example only with reference to the accompanying figures in which:

FIG. 1 shows an arrangement of the prior art in which a tissue sample 1 has been covered by matrix and thereafter ions have been generated from a number of sample target sites 3 throughout the sample. As noted above, the mass data obtained from each of these sample target sites can be used to build up a map or image of the tissue sample.

Figure 1:
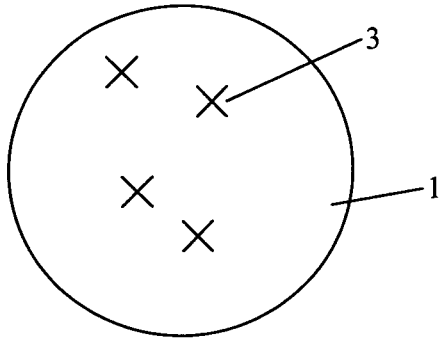
Figure 1 Prior Art
FIG. 1 shows an arrangement of the prior art.
Figure 2:
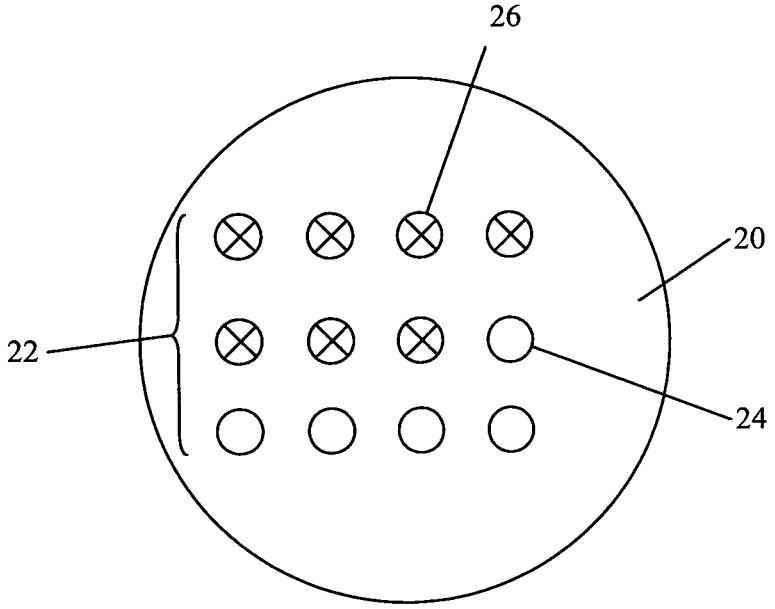
Figure 2 Prior Art
FIG. 2 shows another arrangement of the prior art.

FIG. 2 shows another arrangement of the prior art. In this arrangement, the tissue sample 20 has applied to it an array of spots 22, each spot 24 comprises matrix.

Ions are generated from coordinates corresponding approximately to the centre of each spot 26. The laser is fired repeatedly at each sample target site 26 to generate an averaged mass data for each spot. This average mass data can then be used to build up an image of the tissue sample 20.

Figure 3:
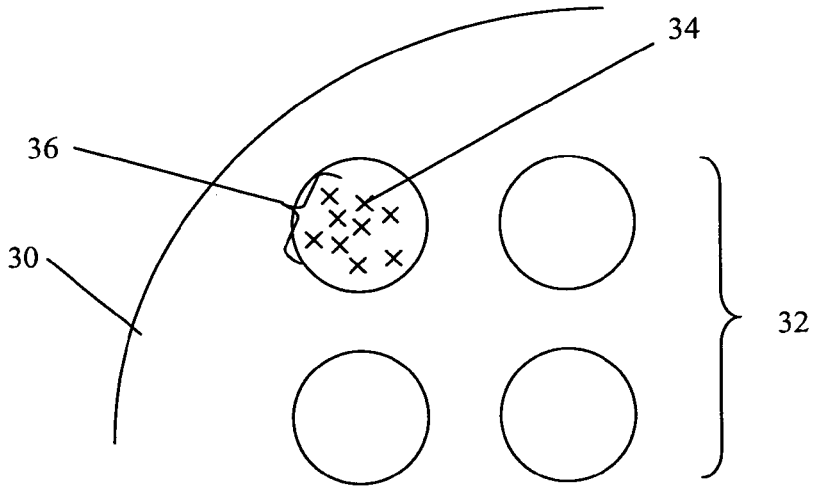
FIG. 3 shows an embodiment of the present invention.

FIG. 3 illustrates an embodiment of the present invention. FIG. 3 shows a close-up of part of a tissue sample 30 to which has been applied an array of spots 32. Thus far, the arrangement is the same as that of the prior art. However, unlike the prior art, ions are generated not only from the approximate centre of each spot 34, but also from a plurality of locations 36 associated with the sample target site 34. The plurality of locations 36 are selected based on the coordinates of the sample target sites 34.

Thus, in this arrangement, the sample stage on which the sample is mounted is moved using a stepper motor having increments of 10 μm. The respective each one of the plurality of locations is therefore spaced from the other locations by at least 10 μm (indeed it is preferred that the spacing between the locations is at least 5 μm, more preferably at least 10 μm, suitably a spacing corresponding to the step size of the stepper motor). In practice, a grid of possible locations is available, each point on the grid being spaced from the adjacent point by 10 μm. Thus, in the case of a spot having a diameter of about 120 μm, a grid of approximately 10 by 10 locations is available. A random selection of five such locations within the grid is made and ions are generated from each of these. As discussed previously, more than five locations may be selected, e.g. 10 or more. A non-random selection could also be made (e.g. based on a predetermined pattern).

Figure 4:
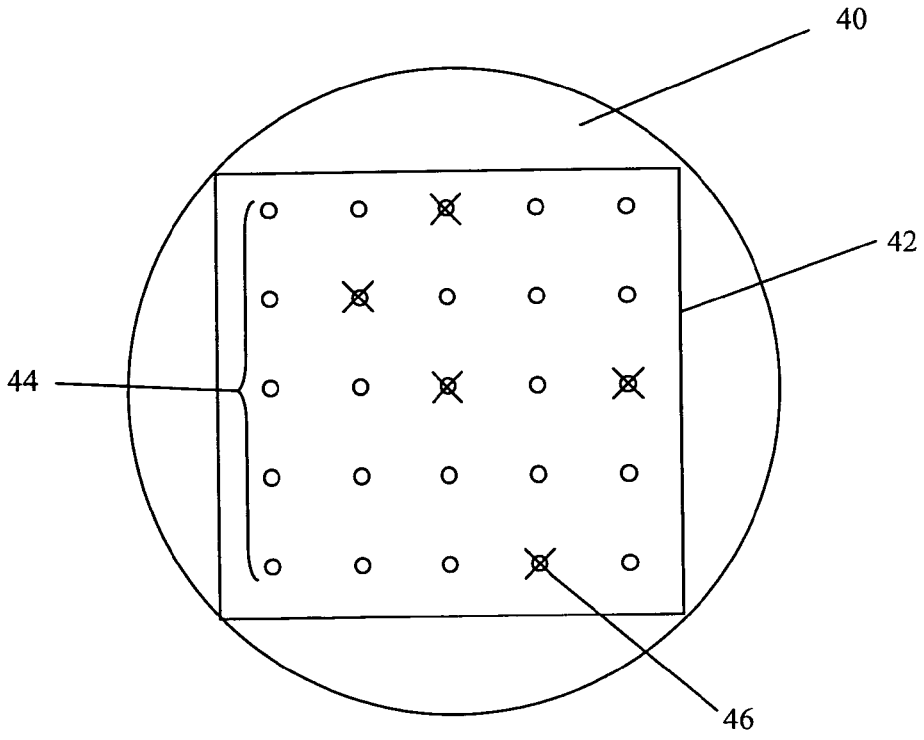
FIG. 4 shows an embodiment of the present invention, being a preferred arrangement associated with FIG. 3.

Turning to FIG. 4, the arrangement of a grid of possible locations within the spot is illustrated more clearly. Here, a spot 40 having a diameter of approximately 120 μm has formed within it a grid 42 of possible locations 44, the grid having a height and width of approximately 100 μm. Thus, ions can be generated from a plurality of locations 44 that make up the grid 42. In practice, the laser is incident on a plurality (preferably at least 5) of such locations 46.

Figure 5:
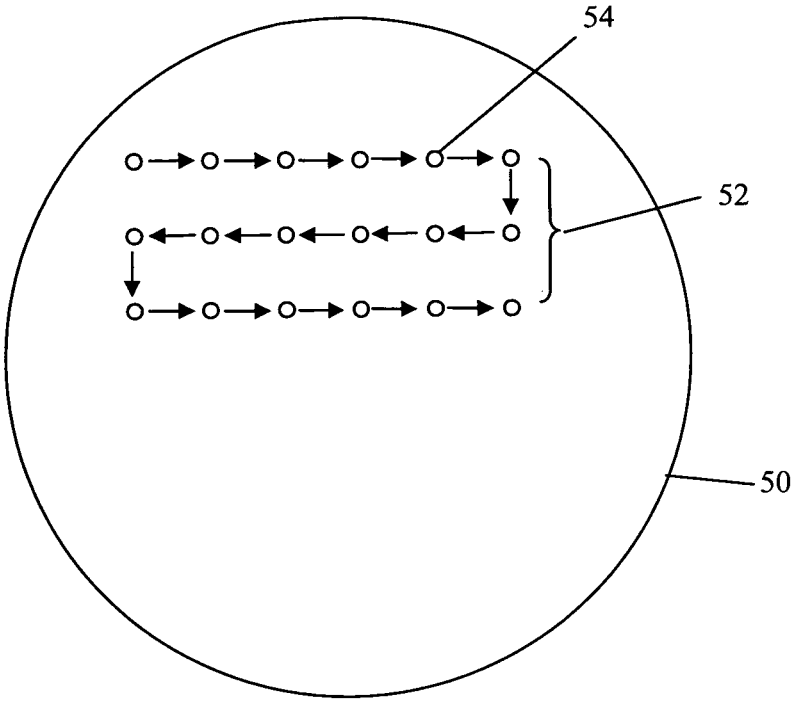
FIG. 5 shows a an arrangement to which the present invention can be applied.

FIG. 5 shows an alternative embodiment of the present invention. Here a sample 50 is mounted on a sample stage. A raster 52 comprising a series of laser impact sites (i.e. sample target sites) is illustrated, e.g. having a serpentine pattern.

Figure 6:
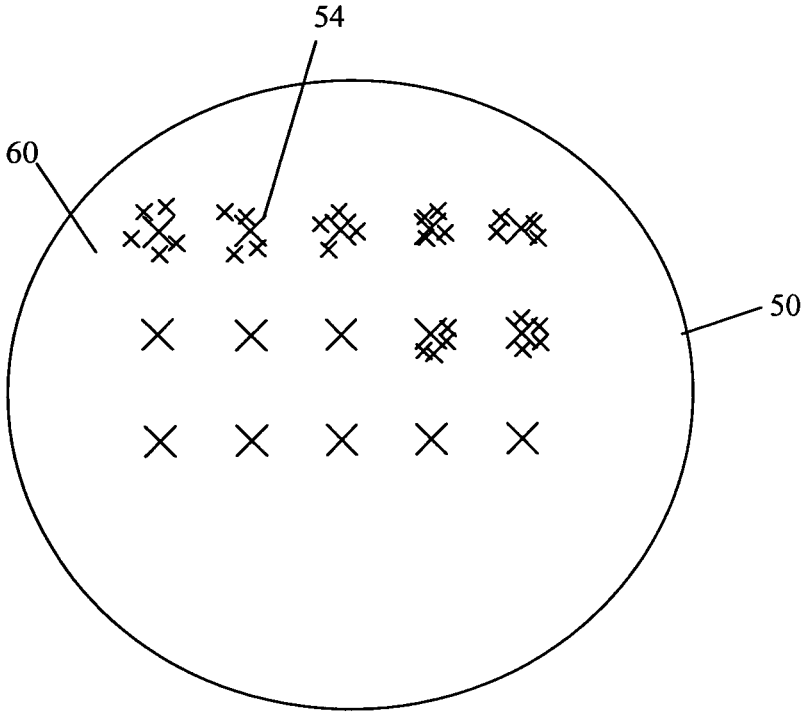
FIG. 6 shows a further embodiment of the present invention.

The present invention enables "dithering" or "roaming" around each of set sample target sites 54. Thus, as shown in FIG. 6, a dither pattern 60 is seen in association with each of the sample target sites 54.

By providing dithering or roaming around each of a plurality of sample target sites (in particular within each spot of an array of spots), the present invention improves the reliability of the mass data obtained from a sample. In particular, it reduces the adverse effects of defects in matrix applied to a sample (either in terms of crystallographic defects or the thickness of matrix applied to the sample). This can lead to mass data that more accurately reflects the composition of the sample at a given sample target site and furthermore assists in the generation of more accurate and more reliable images or maps of a tissue sample.

Figure 7:
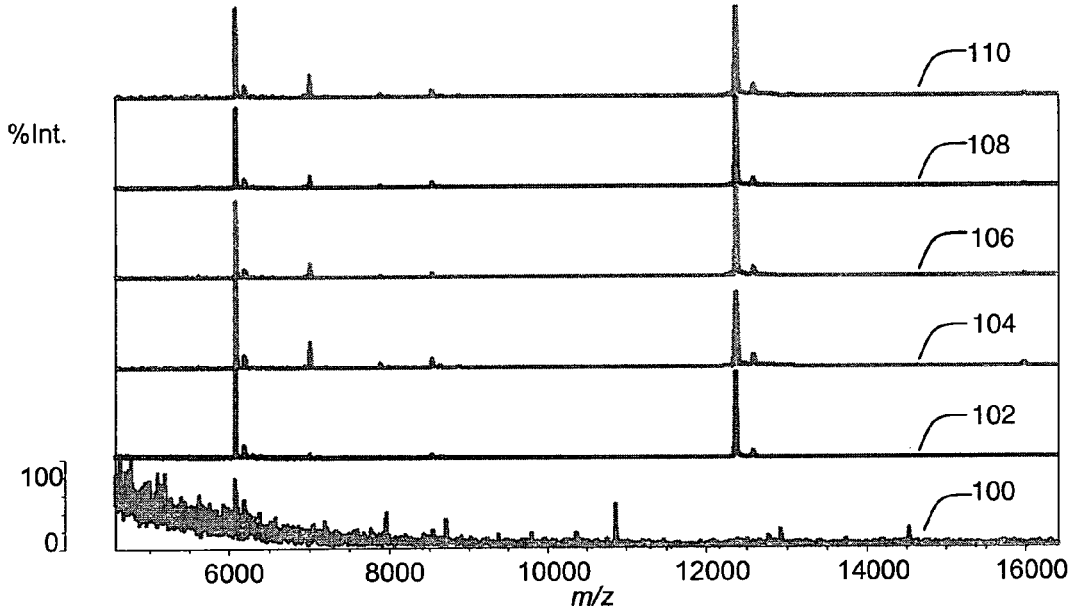
FIG. 7 shows mass spectra obtained with and without the method of the present invention.

FIG. 7 shows six mass spectra (2 sets of three spectra) obtained from the same sample. The Experiment conditions were as follows: Sample is a standard protein mixture printed using CHIP-1000 to provide 10×10 print positions (pp) spaced at 250 um, 20 nl/pp printed with 5 drop iterations. Data acquisition: 200 laser shots/pp. For acquisitions with laser roaming—60 um pp radius, 10 shots per movement. Data was acquired three times for each sample spot (print position).

The spectra illustrate the effect of the invention on the quality of the total spectrum averaged across multiple sample spots (which sample spots have been produced by chemical inkjet printing and so the coordinates of the sample spots correspond to the print positions).

Each spectrum in a set of three shows the averaged signal after successive acquisitions from all the sample spots. Spectra 100, 102 and 104 were obtained without using the "roaming" method of the present invention. These three spectra correspond to the successive acquisitions from the sample spots, such that 100 was obtained first, then 102 and finally 104. As can be seen from FIG. 7, the signal intensity falls rapidly with repeated acquisition at the same locations within sample spots. This is because the sample is consumed.

In contrast the spectra 106, 108 and 110, which were obtained using the "roaming" method of the present invention demonstrate a consistent level of signal intensity and there is no reduction after three acquisitions. This is because, even though each spectrum is representative of the composition of the same sample, the "roaming" method of the present invention acquires the data from different locations within sample spots. This means that there is much less fall off in signal after repeated acquisition.

Figure 8:
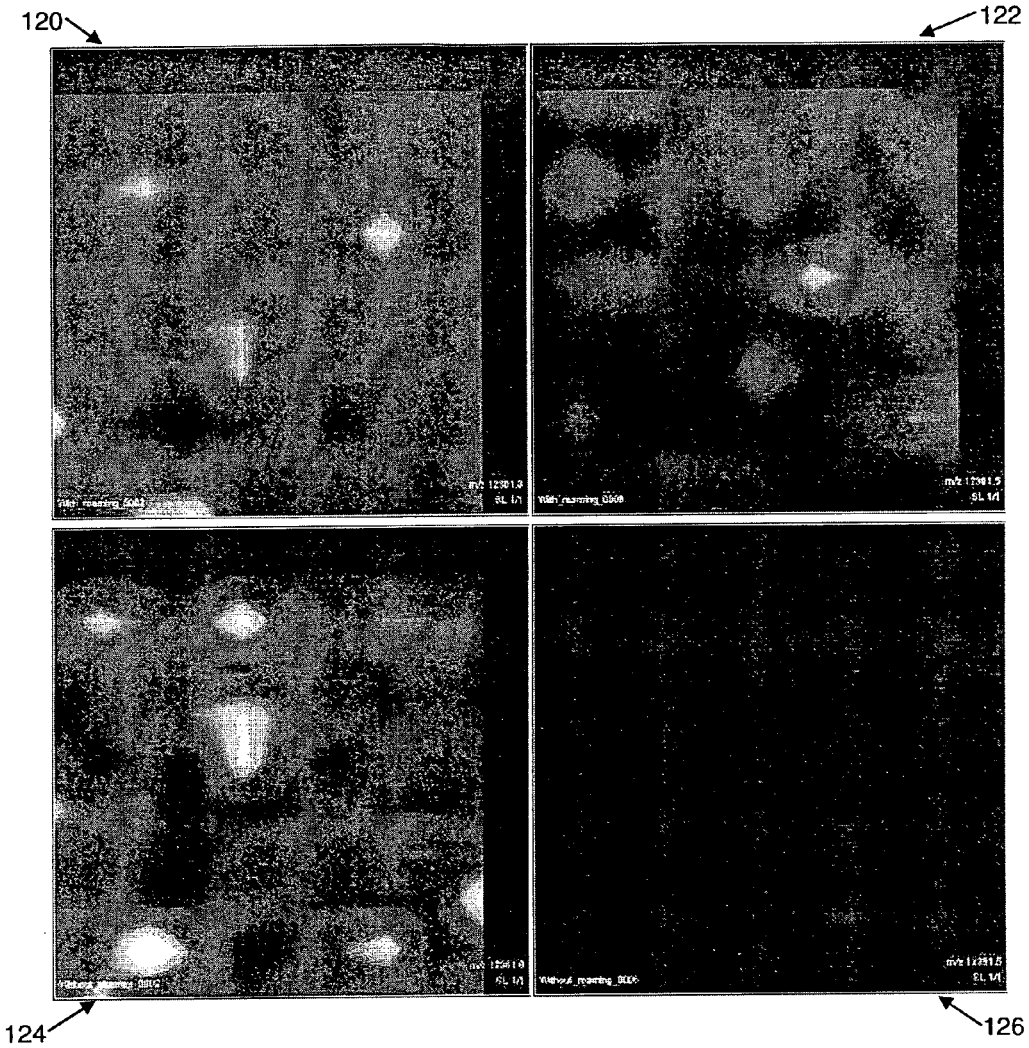
FIG. 8 shows image maps obtained from a sample with and without the method of the present invention.

FIG. 8 shows a further example of the effect of the invention, this time on the intensity distribution (image or intensity map) across an array of sample spots (print positions). The two upper images 120 (1st acquisition) and 122 (3rd acquisition) were obtained using the "roaming" method of the present invention and it can be seen from FIG. 8 that the relative ion intensities are more homogeneous over the scanned area as compared to lower images 124 (1st acquisition) and 126 (3rd acquisition) obtained without using the method of the present invention. Thus, acquisition without "roaming" leads to some data being very low in intensity. However, when the "roaming" method of the present invention is used, good quality homogeneous data can be acquired, even after the third data acquisition.

These preferred embodiments have been described by way of example and it will be apparent to those skilled in the art that many alterations can be made that are still within the scope of the invention.

The invention claimed is:

1. A method of generating ions from a plurality of sample target regions on a MALDI sample plate in a mass spectrometer using a pulsed laser, each sample target region comprising matrix, the method comprising the steps of (1) designating and rastering a plurality of sample raster sites on the MALDI sample plate, wherein each of the sample raster sites corresponds to one of the sample target regions and has a single set of sample target coordinates, and the plurality of sample raster sites are designated and rastered in a non-random manner such that the sample target regions are arranged consecutively along the sample plate in rows, (2) dithering at each of said plurality of sample raster sites so as to generate ions from a plurality of discrete dither locations associated with each sample raster site, wherein each said plurality of discrete dither locations comprises discrete dither locations that are selected automatically with reference to the sample target coordinates of the associated sample raster site, each discrete dither location of each plurality of discrete dither locations corresponds to at least one distinct shot of the pulsed laser, and each discrete dither location of said plurality of discrete dither locations is selected randomly with reference to the sample target coordinates of the associated sample raster site, and (3) detecting at least some of the generated ions, obtaining mass data about the ions generated at each of the randomly selected plurality of dither locations, and processing the mass data to produce composition data relating to the composition of the sample at each of the plurality of sample raster sites, whereby said dithering reduces or eliminates the adverse effects on the mass data associated with defects in the matrix of the sample target region.

2. A method according to claim 1, wherein each of the said plurality of sample raster sites is associated with a corresponding sample region that is a discrete sample region, and wherein the sample is part of a MALDI ion source and the plurality of discrete sample regions comprise regions of matrix.

3. A method according to claim 2, wherein the method includes the step of, prior to step (1), forming the discrete sample regions by applying drops of matrix to the sample using a chemical ink jet printer.

4. A method according to claim 2, wherein the discrete sample regions are substantially circular and have a diameter of <200 μm.

5. A method according to claim 2, wherein the plurality of discrete sample regions comprise a 2-D array of spots, the 2-D array comprising at least 10 columns and at least 10 rows.

6. A method according to claim 1, wherein the center-to-center separation of the sample raster sites is no more than 300 μm.

7. A method according to claim 1, wherein the sample is a tissue sample.

8. A method according to claim 1, wherein the said plurality of dither locations associated with each sample raster site comprises at least 10 locations.

9. A method according to claim 1, wherein a distance between each of the plurality of dither locations is <25 μm.

10. A method according to claim 1, wherein the step of generating ions from the plurality of dither locations comprises firing a laser at the sample at least ten times at each of the plurality of dither locations.

11. A method according to claim 1, wherein the method is a method of generating ions from an ion source in a mass spectrometer, and the method comprises the steps of detecting at least some of the generated ions, obtaining mass data about the ions generated at each of the plurality of dither locations, and processing the mass data to produce composition data relating to the composition of the sample at each of the plurality of sample raster sites.

12. A method according to claim 11, wherein the step of processing the said mass data comprises, for each of the plurality of sample raster sites, averaging at least some of the mass data obtained from the plurality of dither locations.

13. A method according to claim 12, wherein the method comprises the further step of generating an image of the sample based on the processed mass data for each of the plurality of sample raster sites.

14. A method according to claim 12, wherein the method includes detecting a mass associated with a biomarker, the biomarker being indicative of a pathological condition and generating an image of the sample based on detected amounts of biomarker at each of the plurality of sample raster sites.

15. A method according to claim 1, wherein the step of generating ions from a plurality of dither locations associated with one of the plurality of sample raster sites comprises communicating to a processing device only a single set of sample position coordinates for all of the said plurality of dither locations, said single set of sample position coordinates corresponding to the coordinates of the sample raster site with which the plurality of dither locations is associated.

16. A method according to claim 15, wherein the sample raster site is associated with a discrete sample region and the said single set of sample position coordinates corresponds to the center of the discrete sample target region.

17. A method according to claim 16, wherein for each of said plurality of sample raster sites, the method includes processing mass data from all of the plurality of dither locations with respect to the single set of sample position coordinates.

18. A method according to claim 1, wherein the sample is part of an ion source and in use a laser source provides a laser beam to generate ions from the sample, and wherein the step of generating ions from a plurality of dither locations associated with the sample raster site includes moving the ion source with respect to the laser source, wherein moving the ion source with respect to the laser source comprises moving a sample stage to which the sample is attached by a stepper motor, and wherein the plurality of dither locations are selected based on a step size of the stepper motor, and wherein the sample is moved with respect to the laser in between firing of the laser.

19. An apparatus configured to carry out the method of claim 1.

20. Apparatus according to claim 19, wherein the apparatus is a mass spectrometer comprising an ion source, a laser and control means for controlling movement of the ion source with respect to the laser so that the laser can be fired at the said plurality of dither locations associated with the said sample raster site.

21. Apparatus according to claim 20, wherein the control means comprises processing means for selecting automatically said plurality of dither locations with reference to the said sample raster site and wherein the processing means is configured to select randomly the plurality of dither locations or is configured to select the plurality of dither locations in accordance with a predetermined pattern.

22. The method according to claim 1, wherein the plurality of discrete dither locations associated with each sample raster site comprises at least 10 discrete dither locations.

23. The method according to claim 1, wherein the distance between each of the plurality of dither locations and the sample raster site with which they are associated is less than one half of a distance between adjacent sample raster sites.

24. The method according to claim 1, wherein the number of discrete dither locations for each sample raster site is substantially the same.

25. The method of generating ions according to claim 1, wherein the distance between each of the plurality of dither locations and the sample raster site with which they are associated is less than one half of a distance between adjacent sample raster site.

26. The method of generating ions according to claim 25, wherein the step of generating ions from a plurality of locations associated with one of the said plurality of sample target sites comprises communicating to a processing device only the single set of sample position coordinates of the sample raster site for all of the said plurality of locations.

* * * * *